US005085511A

United States Patent [19]

Grisel

[11] Patent Number: 5,085,511

[45] Date of Patent: Feb. 4, 1992

[54] LOADED SHOTGUN SHELL TESTING APPARATUS USED TO VISUALLY INSPECT, VIA TRANSMITTED LIGHT IMAGES, THE INTERNAL ARRANGEMENT OF THE POWDER, WAD, AND SHOT

[76] Inventor: Howard L. Grisel, 1224 Newton Creek Rd., Roseburg, Oreg. 97470

[21] Appl. No.: 486,166

[22] Filed: Feb. 28, 1990

[51] Int. Cl.[5] ..... G01N 21/88

[52] U.S. Cl. ..... 356/239; 356/64; 73/167

[58] Field of Search ..... 356/64, 66, 237, 239, 356/240; 73/52, 167; 250/341, 358.1

[56] References Cited

U.S. PATENT DOCUMENTS

| | | | |
|---|---|---|---|
| 993,965 | 5/1911 | Davis . | |
| 1,023,091 | 4/1912 | Morris . | |
| 1,073,594 | 9/1913 | Cripps . | |
| 1,142,535 | 6/1915 | Shimota et al. . | |
| 1,322,750 | 11/1919 | Brander . | |
| 1,927,874 | 9/1933 | Lohner | 356/237 |
| 3,680,966 | 8/1972 | Cofek et al. | 356/241 |
| 4,025,422 | 5/1977 | Malvick et al. | 250/341 |
| 4,203,673 | 5/1980 | Duckson | 250/223 R |
| 4,454,947 | 6/1984 | Jacobsmeyer et al. | 73/167 |

FOREIGN PATENT DOCUMENTS

| | | | |
|---|---|---|---|
| 472143 | 9/1937 | United Kingdom | 356/240 |

*Primary Examiner*—Richard A. Rosenberger
*Attorney, Agent, or Firm*—Roy E. Mattern, Jr.

[57] ABSTRACT

Shotgun shell testing apparatus positions a loaded shotgun shell in the path of a light source. An observer, generally a shooter, places his or her supposedly properly loaded shotgun shell in a receiving space of this apparatus and turns on the lighting energy source. By observing the resulting internal derived image of the fiber derivative portions of the shell casing, often observable at the exterior of the apparatus, and comparing this image observed with the likeness of an earlier image reflecting a properly loaded shotgun shell of the specified power charge, a shooter is able to determine if the shotgun shell being tested, via this observation, has been correctly loaded in respect to the positioning of the powder, wad, and shot.

10 Claims, 2 Drawing Sheets

LOADED SHOTGUN SHELL TESTING APPARATUS USED TO VISUALLY INSPECT, VIA TRANSMITTED LIGHT IMAGES, THE INTERNAL ARRANGEMENT OF THE POWDER, WAD, AND SHOT

BACKGROUND

In respect to the shooting of shotguns held in the hands of a shooter and positioned against the shoulder of the shooter, while being aimed at a target, to be fired in competitive tournaments, there previously was no known testing apparatus, whereby the shooter could visually pre-check an overall internal loading configuration of his or her shells in respect to the correct positioning of the powder, wad, and shot, within the fiber derivative portions of the shell casing. Consequently, when shooting in a tournament, expert shooters on occasions, did not score as well as they had expected they would score. The Applicant has determined that one reason the expected scoring has not been realized, centers on the possible incorrect arrangement of the loading of one or more of the shotgun shells fired during the competition.

Although no known testing apparatus for this specific purpose is believed to be available, there have been previously designed apparatuses used in inspecting components of ammunition. For example, Messrs. Cofek and Farrace in their U.S. Pat. No. 3,680,966 in 1972, illustrated and described their apparatus and method for metal shell casting inspection. Metal shell casings for shell ammunition were inspected to determine if designed apertures in these metal shell casings were in fact properly made in the right places and in the right sizes. If not, inspecting light sources would create light, which would be blocked from view, and which therefore would not reach a light detector or a light detection locale. The absence of the light at a designated locale, indicated to observing inspectors, via indicating equipment, that a metal shell casing was defective in respect to these apertures.

Also Messrs. Jacobemeyer and Reding in their U.S. Pat. No. 4,454,947, illustrated and described their inspection and ejection system to measure the respective anvil-to-base heights of battery cups used in ammunition primers. They provided photoelectric check stations. When a battery cup was present and acceptable, a light beam was blocked. When a battery cup was missing or defective, the light was not blocked. The passing light beam was detected, indicating the need for removing a battery cup or other portions of the ammunition which were defective.

Apart from the manufacture of ammunition, the use of light in inspecting apparatus is undertaken in many ways for many purposes. By way of examples, Isaac Davis in his U.S. Pat. 993,965, in 1911, illustrated and described his egg tester. In an enclosure, he provided a light bulb source of light, which directed light up through a top opening, sized to receive a less than one half portion of an entire egg, arranged horizontally above this top opening. This egg tester, or egg candling unit, would let an inspector, an observer, and/or a customer, see sufficient light passing through an egg, if the egg was still fresh enough to be sold as good food.

Like egg inspections were undertaken using:

Mr. Cripps' egg tester disclosed in his U.S. Pat. No. 1,073,594 of 1913; Messrs. Caraway and Shimota's egg candling apparatus disclosed in their U.S. Pat. No. 1,142,535 of 1915; and Mr. Brander's egg tester described and illustrated in his U.S. Pat. No. 1,322,755 of 1919.

SUMMARY

A competitive shooter, and other persons, wanting to know ahead of time, that a shotgun shell they are loading in his or her shotgun will produce the useful firing power that is specified and expected, now have shotgun shell testing apparatus available for their use to optically observe any possible defect in the loading of the powder, wad, and shot. Previously, even though care was taken in measuring respective powder and shot weights, and in the further making of a shotgun shell, oftentimes, after a firing occurred, there was a realization that the specified or wanted firing power was not fully realized. When such a lower powered firing occurred, often during shooting tournaments, it resulted in the shooter being totally scored lower than he or she wanted to be. To eliminate this unwanted cause of a poorer scoring shot, this shotgun shell testing equipment, in respect to one or more embodiments, is used.

Each embodiment has a hollow compartment, formed with a shotgun shell receiving space, either partially or fully encircling the ends of the shotgun shell. The fiber derivative portions of the shell casing are positioned so light may be directed toward and possibly through these portions. Then, within the compartment is a light energy source, generally positioned below the shotgun shell receiving space. Depending on the embodiment, electrical circuitry delivers electrical energy to the light energy source, such as a light bulb, from a utility power circuit of a dwelling, via an electrical cord, or from a self contained battery, which may or may not be rechargeable.

The shotgun shell, when partially encircled and lighted from below, is directly observable from above by the shooter or other concerned person. When the shotgun shell is completely encircled in the hollow compartment and lighted from below, then the shotgun shell is observable by looking through a transparent glass or plastic cover of an opening in the otherwise closed hollow compartment.

When the electrical power is switched on by manipulating a finger switch and/or by the depression of a spring biased switch depressed by the weight of the shotgun shell itself, the light energy is provided to direct light in the direction of the shotgun shell. The shooter, then observing the shotgun shell sees an image which he or she may compare with an image, earlier determined to be the image of a correctly loaded shotgun shell with respect to the powder, wad, and shot. If the images are alike the shotgun shell passes this optical testing. If not, the shotgun shell is not used in competitive tournaments.

To reduce the need for many compartment models of this testing apparatus in respect to testing different sizes and/or gauges of shotgun shells, preferably transparent adapters are used to partially or completely encircle smaller shotgun shells, or portions thereof, before or after their placement with respect to the hollow compartment in making preparations for optical observing of these shotgun shells. Other accessories such as a remote observing screen may be used. Also in some embodiments resettable linear spaced markers are provided to establish reference locations with respect to: where the powder volume should commence and stop;

where the wad should commence and stop; and where the shot should commence and stop, if the shotgun shell being observed has been properly made.

BRIEF DESCRIPTION OF DRAWINGS

Embodiments of this loaded shotgun shell testing apparatus are illustrated in the drawings, wherein.

DESCRIPTION OF THE PREFERRED EMBODIMENTS

Figure 1:
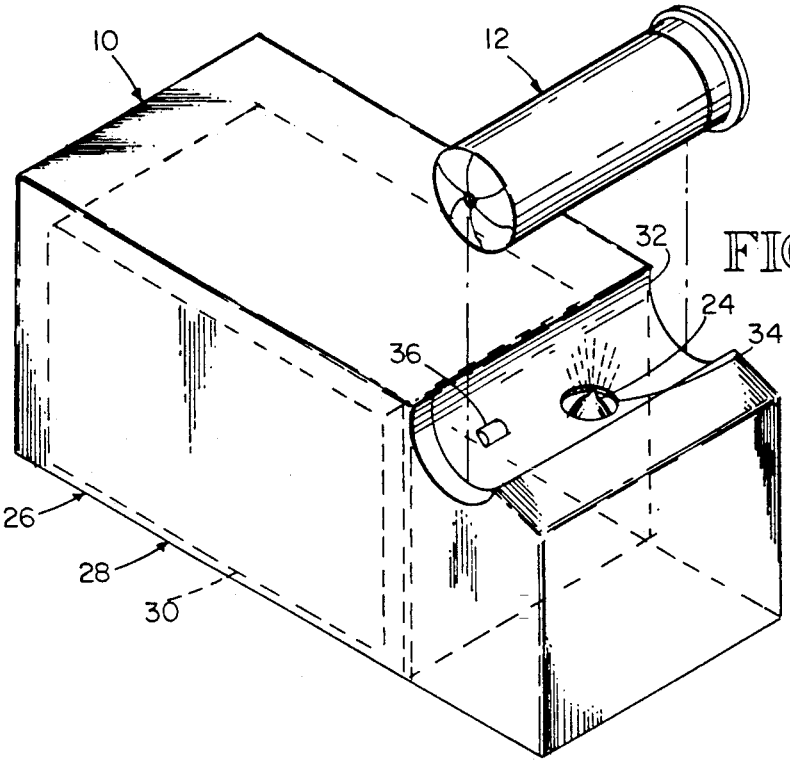
FIG. 1 is a perspective view of an embodiment which partially will receive a lowered shotgun shell placed over a light source, which is turned on by a switch triggered upon contact with a shotgun shell, and electrical energy of a lantern sized battery.

In the drawings, preferred embodiments of this loaded shotgun shell testing apparatus 10 are illustrated. All embodiments are directed by their design to give a competitive shooter the ability to view an image of his or her loaded shotgun shell 12, to determine whether or not each of these shells 12 to be fired in a tournament have been properly loaded with respect to the specified correct positioning of the powder 14, wad 16, and the shot 18 in its entirety, in reference to the overall collection of the pellets 20, thereof. The powder 14, wad 16, and shot 18, are loaded into the shotgun shell 12 occupying the fiber derivative portions 22 thereof, which permit light energy to pass from a light source 24, such as a light bulb 24, through these fiber portions 22, and thereafter be dispersed to create the image to be viewed by the shooter, an inspector, and/or an observer.

Figure 7:
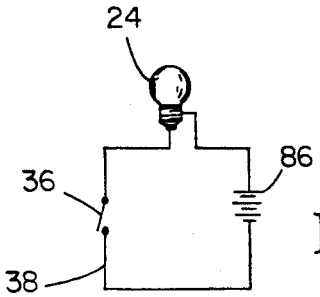
FIG. 7 is a schematic view of minimum circuitry and electrical components of these shotgun shell testing apparatuses.

In the FIG. 1 the shell testing apparatus 10 is illustrated in its lantern battery embodiment 26, having a hollow compartment housing 28 to position a lantern battery 30. At one end of this housing 28 is a partial cylindrical receiving support 32 formed in this housing 28 to receive and to position a loaded shotgun shell 12. A centrally located opening 34 in the bottom of this support 32 permits light to pass through, coming from a light bulb 24 installed inside the hollow compartment housing 28. The light bulb 24 is turned on when the loaded shotgun shell 12 is lowered in place on the receiving support 28, because the shell 12 bears down on a light switch 36 mounted in the housing 28, to activate it and thereby complete an electrical circuit 38. This circuit 38 is schematically shown in FIG. 7, and like electrical circuit 38 arrangements and light sources 24, with some modifications, are arranged within the hollow housing 28, and utilized in respect to all embodiments of this loaded shotgun shell testing apparatus.

When a shooter, or other person, lowers a loaded shotgun shell 12 into position on this lantern battery embodiment 26, the then turned on light bulb 24, causes an image to be formed and to be viewed from above the fiber derivative portions 22 of the casing 40 of this loaded shotgun shell 12. The shooter, by observing this image, learns whether or not the shell 12, he or she is observing, is arranged internally like a shell that produced an image he or she previously observed, which had previously been determined as being correctly loaded in respect to the internal positioning of the powder 14, wad 16, and shot 18.

Figure 2:
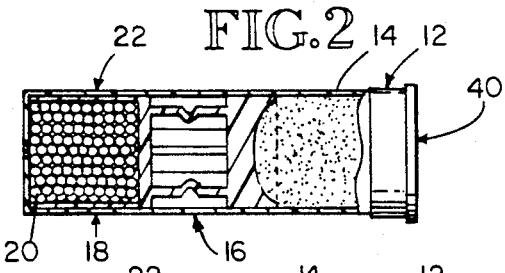
FIG. 2 is a side view, with portions removed, to present what the shooter will learn from viewing an image provided when this shotgun shell testing apparatus is utilized, with this FIG. 2, indicating the wanted positioning of the powder, wad, and shot, the shot components being fully drawn in respect to all the pellets of the overall shot loading.
Figure 3:
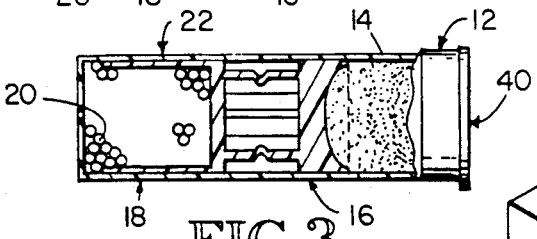
FIG. 3 is similar to FIG. 2 but indicates that unwanted less powder and more shot has been placed within the shell casing, the shot components not being fully drawn, only for convenient illustration purposes.
Figure 4:
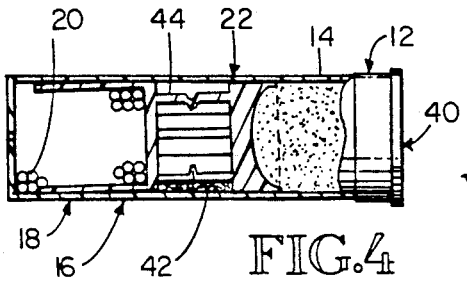
FIG. 4 is similar to FIGS. 2 and 3, but indicates the same amount of powder as shown in FIG. 2, but indicates some of the powder has moved about the wad which has become canted in an unwanted ineffective location.

In FIGS. 2, 3, and 4, the internal arrangement of the powder 14, wad 16, and shot 18 is respectively illustrated, in respect to what the observed images mean to a shooter using this loaded shotgun shell testing apparatus 10. In FIG. 2 the correctly loaded shotgun shell 12 is shown. In FIG. 3, the shell 12 is arranged correctly, but the powder 14 is insufficient. In FIG. 4, the shell is arranged almost correctly, and the powder appears to be sufficient in quantity, yet a small portion of the powder 14 has reached an unwanted volume 42, which is located around the cylindrical exterior 44 of the wad 16 and in the interior of the wad 16, which has become canted. This mislocated powder 14, when the loaded shotgun shell is fired fails to actively contribute to the speed of the pellets 20 of the departing shot 18.

Figure 5:
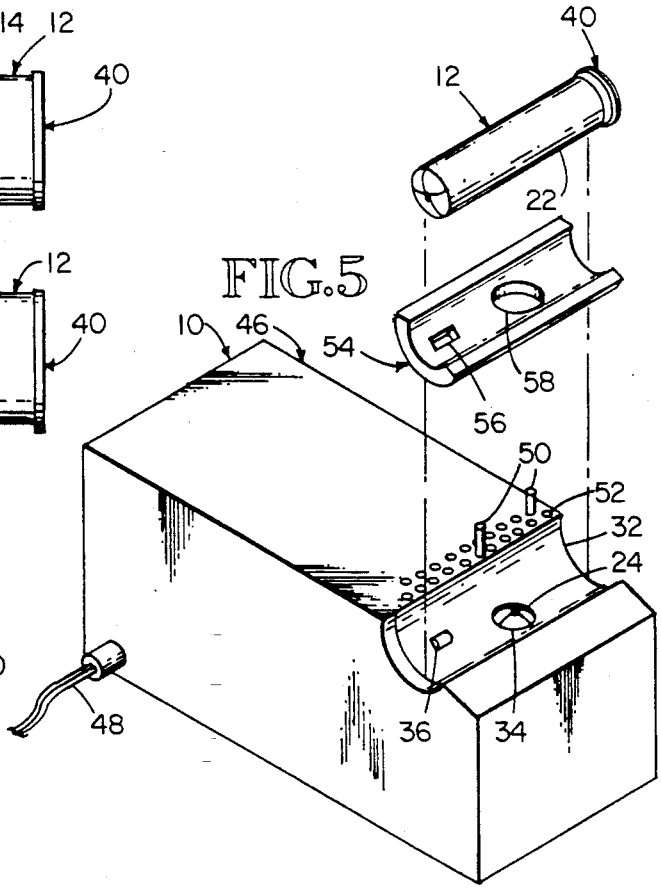
FIG. 5 is a perspective view similar to FIG. 1, showing another embodiment, having an electrical cord, and movable pin indicators, positioned where the powder commences and ends, the wad is located, and the shot commences and ends, and also showing how partial positioning inserts are used to hold a smaller diameter shot shell in place.

In FIG. 5, an embodiment 46 is illustrated, which is referred to as the outside electrical power source embodiment 46, receiving such power through its extending electrical cord 48. The arrangement of almost all the components are similar to the arrangement of components illustrated in FIG. 1. Other components are used however, such as the movable reference pins 50 or markers 50, and the rows of spaced receiving holes 52 into which the reference pins 50 are selectively placed. When an image of a fully correctly loaded shotgun shell of a given specification is being observed, when this shell 12 is in the receiving support 32, the shooter places the respective pins 50 in respective holes 52 to create the reference locales to be later referred to, when another loaded shotgun shell 12 has been loaded in this loaded shotgun shell testing apparatus 10, in place of the known fully correctly loaded shotgun shell 12. If the following loaded shotgun shell 12 creates an image which positions the powder 14, wad 16, and shot 18 in respective direct references to these reference pins 50, and no powder 14 has been lodged in the wrong unwanted volume 42 of powder, then this tested loaded shotgun shell 12, based on this positioning test, is considered ready to be fired in a shooting tournament.

If in using this embodiment 46 or the embodiment 26 of the loaded shotgun shell testing apparatus 10, the partial cylindrical receiving support 32 for the loaded shotgun shell 12 has too large a radius for accurately receiving and positioning a smaller diameter shell 12, then a partial sleeve 54, having a clearance hole 56 to clear the light switch 32 and an aperture 58 to pass the light, is first placed in this support 32 of the hollow compartment housing 28, as indicated in FIG. 5.

Figure 6:
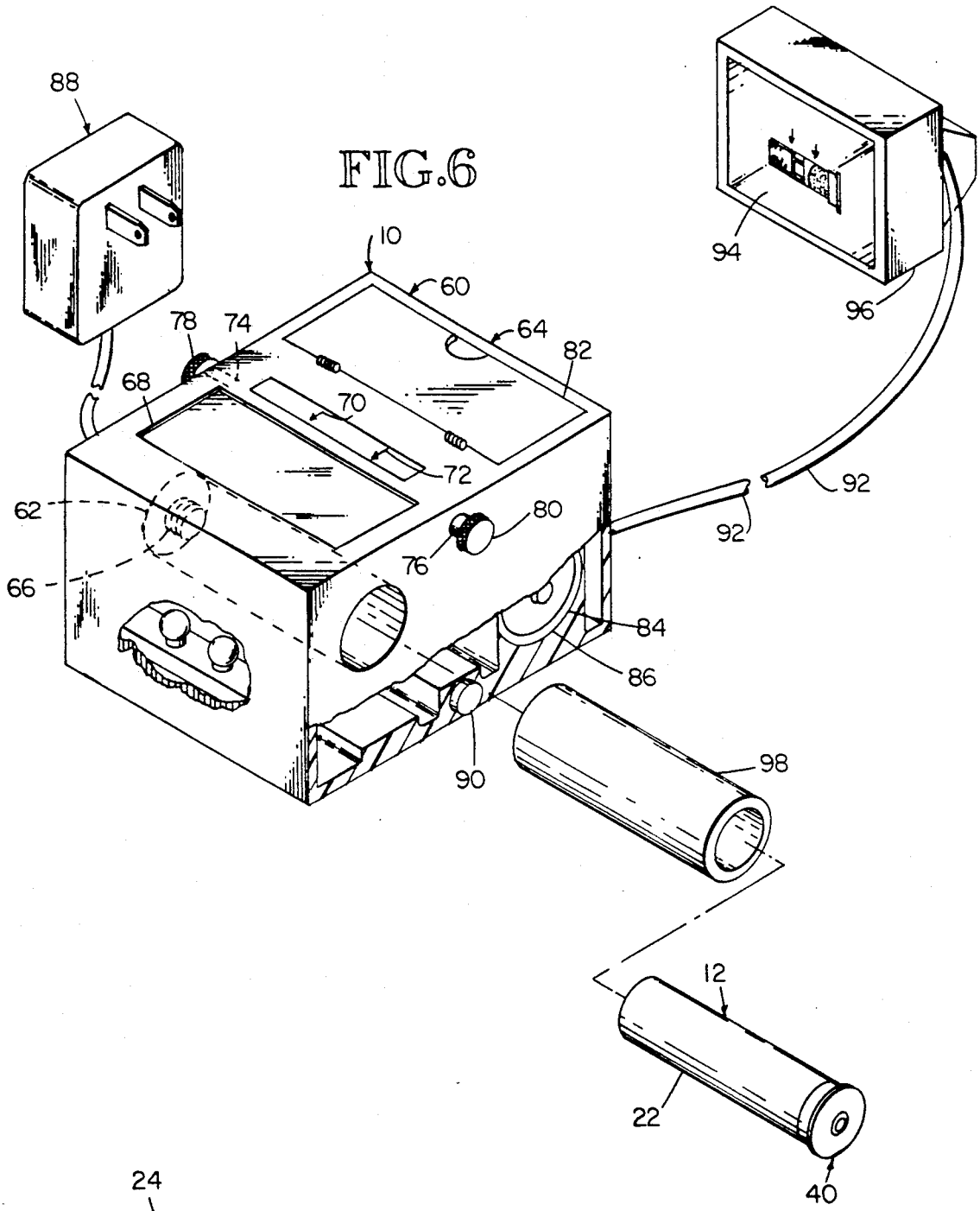
FIG. 6 is a perspective view, with portions removed, of another embodiment illustrating how shotgun shells are inserted lengthwise and horizontally into a circular side entry, over lights, to be observed through a top clear viewing panel, with adjustable markers being used to indicate where the powder is and where the shot is, and showing the use of rechargeable batteries, a power converter, a power cord, optional use of a remote screen to view a loading image of shotgun shells, an ejector spring, and transparent sleeves to position smaller diameter shotgun shells.

A universal embodiment 60 is illustrated in FIG. 6. More light sources 24, such as the two spaced light bulbs 24 are used at a location below a cylindrical receiving volume 62 formed in the rectangular hollow compartment housing 64, in a way which does not interfere with the projected light from the light bulbs 24, being directed toward a loaded shotgun shell 12. The shell 12 is loaded, as indicated by the motion arrow in FIG. 6, into the cylindrical receiving volume 62, and so held there by a shooter. Subsequently a compression spring 66 is utilized to eject the tested shell 12, no longer held in place, part way back out of cylindrical receiving volume 62, so the shooter may grip the shell 12 and continue the removal thereof.

The image of the shell 12 is viewed by looking down through the transparent cover 68. When viewed from above, there are movable thread driven pointers 70, 72 which are set by rotating the screw 74, 76 by turning the respective knobs 78, 80, to place these pointers 70, 72, for example where the powder is located. Also when viewed from above, there is a hinged, or removable cover 82, which provides access to a battery receiving volume 84, in which one or more batteries 86 are positioned. Preferably, these batteries 86 are recharged, when the transformer cord and plug assembly 88 is connected to an outside electrical power supply, not shown. A rotary switch 90 is used to complete the electrical circuit 38, such as schematically shown in FIG. 7, which is arranged within this rectangular hollow housing 64, but not shown in FIG. 6.

Also in FIG. 6, a television cable 92 is illustrated extending between this more universal embodiment 60 of a loaded shotgun shell testing unit, and a somewhat remotely located television screen 94 on a television set 96. The shell image is enlarged and viewed more comfortably as the shooter inserts and removes the loaded shotgun shells 12, with respect to the cylindrical receiving volume 62. The shell image is transmitted to a screen 94, for example, by a radio frequency signal and a TV circuit, or by a electromagnetic wave system.

Also in FIG. 6, a transparent sleeve 98 is illustrated which is placed about a smaller diameter loaded shotgun shell 12, as the latter is being inserted for the testing thereof, to thereafter firmly and centrally position this smaller diameter shell 13 in the receiving volume 62 of the rectangular hollow housing 60 of this more universal embodiment 60, shown in FIG. 6. These sleeves 98 and the partial sleeves 54 are several in number to accommodate the 410, 28, 20, and 16 gauge shotgun shells.

The basic circuitry of all embodiments is schematically illustrated in FIG. 7. There may be different switches used; different light bulbs used; and different electrical energy sources and combinations thereof used. However, the objective remains to direct sufficient light to the loaded shotgun shell 12 to create the image of the inside loading thereof, so a shooter can pre-check each shell 12, before accepting the shell 12 among those shells 12 to be fired during a shooter's competitive shooting time in a tournament, thereby avoiding the under powered shell firing, which otherwise could cause a poor shot score.

I claim:

1. A shotgun shell testing apparatus which creates an optical image observable by a shooter to inform the shooter if his or her shotgun shell has or has not a specified arrangement of the powder, wad, and shot located within the fiber derivative portions of the shell casing, to thereby enable the shooter to only include correctly loaded shotgun shells in a group of them which he or she will shoot in a competitive shooting tournament, or during hunting, comprising:

a) a hollow housing;
b) an electric light source in the hollow housing;
c) an electrical energy source in the hollow housing;
d) a shotgun shell receiving portion of the hollow housing;
e) an electrical switch on the hollow housing;
f) a viewing locale on the hollow housing; and
g) electrical circuitry in the hollow housing interconnecting the electrical light source, the electrical energy source, and the electrical switch:

whereby upon closure of the electrical switch electrical energy from the electrical energy source, via the circuitry, turns on the electric light source, and light is directed toward the shotgun shell receiving portion and the viewing locale of the hollow housing, so that when a shotgun shell is placed in this receiving portion of the hollow housing and observed, the shooter will see an image, which he or she will analyze to determine whether or not the shotgun shell has been loaded according to the specified arrangement of the powder, wad, and shot, before he or she enters a competitive shooting tournament, or during hunting.

2. A shotgun shell testing apparatus, as claimed in claim 1, having, in addition, means to position smaller diameter shotgun shells in the shotgun shell receiving portion of the hollow housing, which is initially made large enough to position the largest diameter shotgun shell.

3. A shotgun shell testing apparatus, as claimed in claim 1, having, in addition, adjustable position indicating means on the hollow housing to indicate to the shooter who is observing the image of the shotgun shell, the specified correct positioning of the powder, wad, and shot, so he or she may compare the locations of the position indicating means with the actual image locations of the powder, wad, and shot.

4. A shotgun shell testing apparatus, as claimed in claim 3, having, in addition, means to position smaller diameter shotgun shells in the shotgun shell receiving portion of the hollow housing, which is initially made large enough to position the largest diameter shotgun shell.

5. A shotgun shell testing apparatus, as claimed in claim 1, wherein the electrical energy source in the hollow housing is supplied by outside electrical power.

6. A shotgun shell testing apparatus, as claimed in claim 1, wherein the electrical energy source in the hollow housing is supplied by a battery.

7. A shotgun shell testing apparatus, as claimed in claim 1, wherein the electrical energy source in the hollow housing is supplied by a rechargeable battery.

8. A shotgun shell testing apparatus, as claimed in claim 1, wherein the electrical circuitry includes means to transmit video signals to a remotely placed television set for viewing the image of each shotgun shell.

9. A shotgun shell testing apparatus, as claimed in claim 1, wherein the electrical switch on the hollow housing is located in conjunction with the shotgun shell receiving portion, whereby upon placement of a shotgun shell in this receiving portion, the electrical switch is turned on, under the weight of the shotgun shell, and turned off, when the shotgun shell is removed.

10. A shotgun shell testing apparatus, as claimed in claim 1, having, in addition, an ejection means located in conjunction with the shotgun shell receiving portion of the hollow housing, whereby, following the viewing of the image of the shotgun shell, the shotgun shell is ejected sufficiently for the continued removal thereof.

* * * * *